US008079869B2

(12) United States Patent
Galloway et al.

(10) Patent No.: US 8,079,869 B2
(45) Date of Patent: Dec. 20, 2011

(54) COAXIAL CONNECTOR ARRAY AND PLUG REMOVAL TOOL

(75) Inventors: Michael D. Galloway, Harrisburg, PA (US); Bruce Champion, Lemoyne, PA (US); Brian Chaney, Harrisburg, PA (US); Matthew Mostoller, Hummelstown, PA (US); Hak Lim, Bryn Mawr, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 197 days.

(21) Appl. No.: 12/506,619

(22) Filed: Jul. 21, 2009

(65) Prior Publication Data

US 2011/0021041 A1 Jan. 27, 2011

(51) Int. Cl.
*H01R 9/05* (2006.01)

(52) U.S. Cl. ..... 439/579

(58) Field of Classification Search ..... 439/578, 439/579, 721, 729, 63; 324/755.02
See application file for complete search history.

(56) References Cited

U.S. PATENT DOCUMENTS 4,506,939 A 3/1985 Faulkenberry et al.
4,664,467 A 5/1987 Tengler et al.
4,743,205 A * 5/1988 Mitani et al. ..... 439/78
4,895,522 A 1/1990 Grabbe et al.
4,964,805 A 10/1990 Gabany
4,988,312 A 1/1991 Suzuki et al.
5,190,474 A 3/1993 Ginet
5,570,068 A 10/1996 Quan
6,071,127 A 6/2000 Acke et al.
6,166,615 A 12/2000 Winslow et al.
6,468,089 B1 * 10/2002 Hubbard et al. ..... 439/63
6,808,395 B2 10/2004 Lin et al.
6,837,741 B2 1/2005 Kuwahara
6,899,545 B2 5/2005 Pollock et al.
6,992,544 B2 1/2006 Barnes et al.
7,018,216 B1 3/2006 Clark et al.
7,364,461 B1 4/2008 Back et al.
7,455,550 B1 11/2008 Sykes
7,479,035 B2 1/2009 Bence et al.

* cited by examiner

*Primary Examiner* — Vanessa Girardi

(57) ABSTRACT

An array of coaxial cables comprising: (a) a conductive substrate having a top surface, a bottom surface, and a plurality of boreholes therebetween; (b) a plurality of coaxial cables, each cable comprising a central conductor, a dielectric insulating layer surrounding said central conductor, and a metallic shielding layer surrounding said dielectric insulating layer; (c) a plurality of receptacles, each receptacle being disposed proximate one of said plurality of boreholes, each receptacle having a first conductive member electrically coupled to said conductive substrate and a first engagement member; (d) a plurality of plugs, each plug being disposed on one of said plurality of coaxial cables, each plug having a second conductive member electrically coupled to said metallic shielding layer and a second engagement member, said first and second engagement members of a respective plug and receptacle interengaging to connect and electrically couple said plug and receptacle; and (e) a contact electrically coupled to said central conductor and presented at said bottom surface.

18 Claims, 7 Drawing Sheets

COAXIAL CONNECTOR ARRAY AND PLUG REMOVAL TOOL

FIELD OF INVENTION

The present invention relates to an electrical termination connector system and, more specifically, to an electrical connector system for reversibly connecting a plurality of coaxial cables to a substrate.

BACKGROUND OF INVENTION

Parallel radiofrequency ("RF") coaxial cables are often used to test electronic components, such as memory and logic chips, simultaneously. Such arrays may have a printed circuit board ("PCB") substrate having numerous coaxial cables permanently soldered to the PCB in a regular pattern. During testing, a robotic arm moves the array into an abutment connection with a mating component and test signals are propagated down each coaxial cable, through the PCB substrate, and into the mating component.

Referring to FIG. 12, an example of a prior art solder connection for a cable array is illustrated. Specifically, to make such a connection, the central conductor 1204 of a coaxial cable 1202 is exposed and inserted with a plug of solder 1203 into a borehole 1205 of a PCB 1201. The connection is heated to reflow the solder and to make the connection permanent. Because of the density of the array and the fact that connection is internal to the borehole, physical inspection of the solder connection tends to be very difficult if not essentially impossible. Consequently, detecting imperfections in the connection is typically performed after the entire array is assembled by measuring its electrical properties.

A typical requirement of coaxial cables arrays is that the cables in the assembly have identical electrical properties. That is, each coaxial cable, each connection, and the entire array should all function together to conform to predetermined specifications. Commonly, each coaxial cable should have the same "electrical length," which is a measure of the amount of time that a signal takes to propagate along the central conductor wire. Electrical length can vary among coaxial cables, even though the mechanical length is identical.

Because of the permanent nature of soldered connections, if, during manufacture, it is discovered that even one coaxial cable lacks satisfactory electronic performance, then the entire assembly must be discarded. Therefore, undesirable material wastage is a problem with traditional manufacture of parallel arrays of coaxial cables having soldered connections. What is needed, therefore, is a convenient, robust, and reversible method for attaching coaxial cables to a PCB substrate. The present invention fulfills this need among others.

SUMMARY OF INVENTION

The present invention provides a reversible, non-permanent connection between a substrate and an array of coaxial cables in which any individual coaxial cable may be easily unlocked, disengaged, and replaced. That is, applicants recognize that, even though added manufacturing complexity and cost may be associated with connecting a coaxial cable to a substrate with a non-permanent (i.e., non-soldered) connector, coaxial cables so connected may be interchangeably removed during manufacture, thereby achieving overall reduced cost by reducing material wastage.

Accordingly, one aspect of the invention is an array of coaxial cables releasably connected to a substrate. In one embodiment, the array comprises: (a) a conductive substrate having a top surface, a bottom surface, and a plurality of boreholes therebetween; (b) a plurality of coaxial cables, each cable comprising a central conductor, a dielectric insulating layer surrounding the central conductor, and a metallic shielding layer surrounding the dielectric insulating layer; (c) a plurality of receptacles, each receptacle being disposed proximate one of the plurality of boreholes, each receptacle having a first conductive member electrically coupled to the conductive substrate and a first engagement member; (d) a plurality of plugs, each plug being disposed on one of the plurality of coaxial cables, each plug having a second conductive member electrically coupled to the metallic shielding layer and a second engagement member, the first and second engagement members of a respective plug and receptacle interengaging to connect and electrically couple the plug and receptacle; and (e) a contact electrically coupled to the central conductor and presented at the bottom surface.

Another aspect of the invention is a coaxial connector system for connecting coaxial cables to a substrate. In one embodiment, the connector system comprises: (a) a receptacle configured to be disposed in a borehole of a conductive substrate, the receptacle having a first conductive member configured for electrical coupling to the conductive substrate and a first engagement member; (b) a plug having a second conductive member configured for electrical coupling to the metallic shielding layer of the coaxial cable, and a second engagement member, the first and second engagement members configured to interengage to connect and electrically couple the plug and receptacle; and (c) a contact adapted to be electrically coupled to the central conductor.

Additional features may be understood by referring to the accompanying drawings, which should be read in conjunction with the following detailed description and examples.

DETAILED DESCRIPTION

Figure 1:
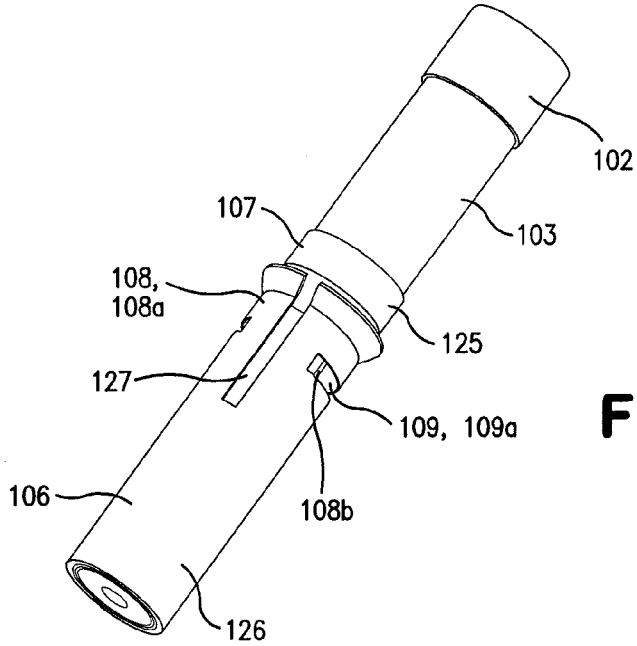
FIG. 1 shows a perspective view of one embodiment of the connector system of the present invention.

Referring to FIGS. 1-6, one embodiment of the array 100 of the present invention is shown. The array 100 comprises (a) a conductive substrate 120 having a top surface 120*a*, a bottom surface 120*b*, and a plurality of boreholes 101 therebetween; (b) a plurality of coaxial cables 102 comprising a central conductor 104, a dielectric insulating layer 105 surrounding the central conductor, and a metallic shielding layer 103 surrounding the dielectric insulating layer; (c) a plurality of receptacles 106, each receptacle being disposed proximate one of the plurality of boreholes 101, each receptacle 106 having a first conductive portion 126 electrically coupled to the conductive substrate and a first engagement member 108, (d) a plurality of plugs 107, one of the plurality of plugs being disposed on each of the plurality of coaxial cables, each of the plurality of plugs having a second conductive portion 125 electrically coupled to the metallic shielding layer 103 and a second engagement member 109, the first and second engagement members 108, 109 of a respective receptacle and plug interengaging to connect and electrically couple the plug to the receptacle; and (e) a contact 110 electrically coupled to the central conductor and extending to the bottom surface 120*b*. Each of these elements is discussed in greater detail below.

The conductive substrate functions to define a plurality of boreholes, to hold receptacles proximate to each borehole, and to electrically couple with each receptacle, which, in turn, is electrically coupled to the metallic shielding layer of a coaxial cable disposed in the receptacle. To this end, the substrate comprises a conductive material such as a metal (e.g. aluminum or stainless steel). Alternatively, the substrate may be a metal-impregnated or a metal-plated plastic or ceramic. In yet another embodiment, the substrate is a printed circuit board (PCB) with metallic traces connecting the various boreholes. Still other substrate embodiments will be obvious to one of skill in the art in light of this disclosure. The boreholes may be any shape including, for example, tapered profiles and polygonal or cylindrical passages, although generally cylindrical boreholes are preferred from a simplicity standpoint.

The connector system of the present invention should serve a number of functions. First, it should releasably secure the coaxial cable to the top of the substrate. Second, it should provide a contact, which is electrically connected to central conductor of the cable, on the bottom surface of the substrate to facilitate electrical connection thereto. Third, it should provide an electrical path (either conductive or capacitive) from the metallic shielding layer of the cable to the conductive portion of the substrate. Accordingly, the plug and receptacle not only mechanically couple, but also electrically couple. To this end, the plug and receptacle are typically formed from a resilient, conductive material such as non-reactive metal, such as a copper alloy. Suitable connector systems provide one or more of the above-mentioned functions.

Provided herein are various examples of suitable connector systems. It should be understood, however, that these examples are for illustrative purposes only and that other embodiments are within the scope of the invention. Furthermore, it should be understood that the various features of the different embodiments may be mixed and matched to form new embodiments depending on objectives and design parameters.

Figure 2:
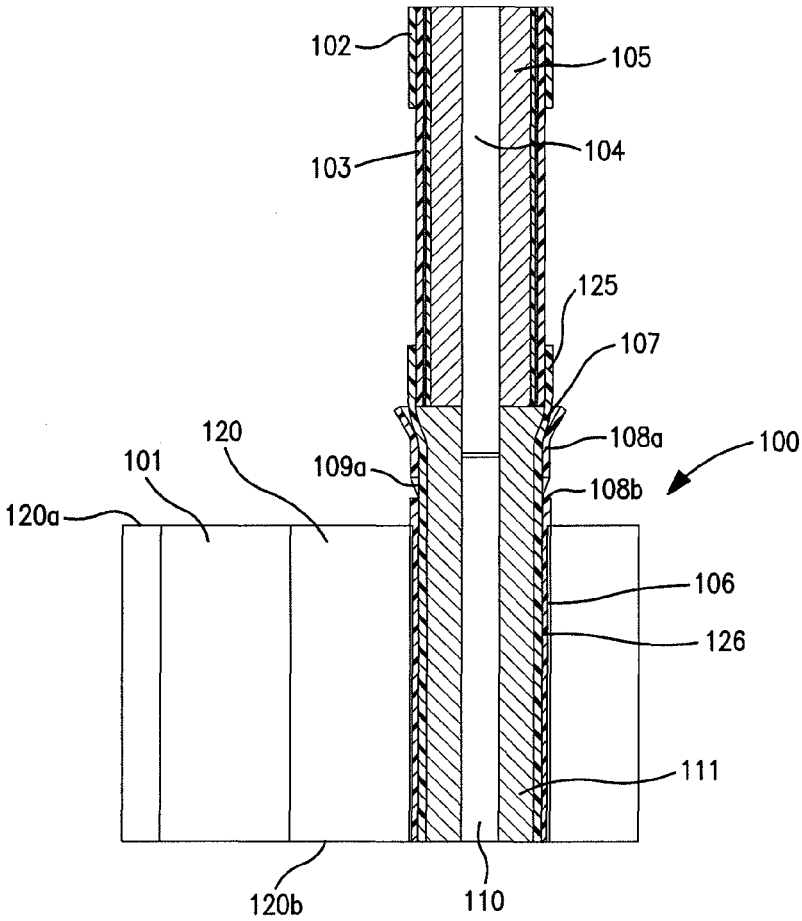
FIG. 2 shows a cross-sectional view of a portion of a cable array using the connector system of FIG. 1.
Figure 3:
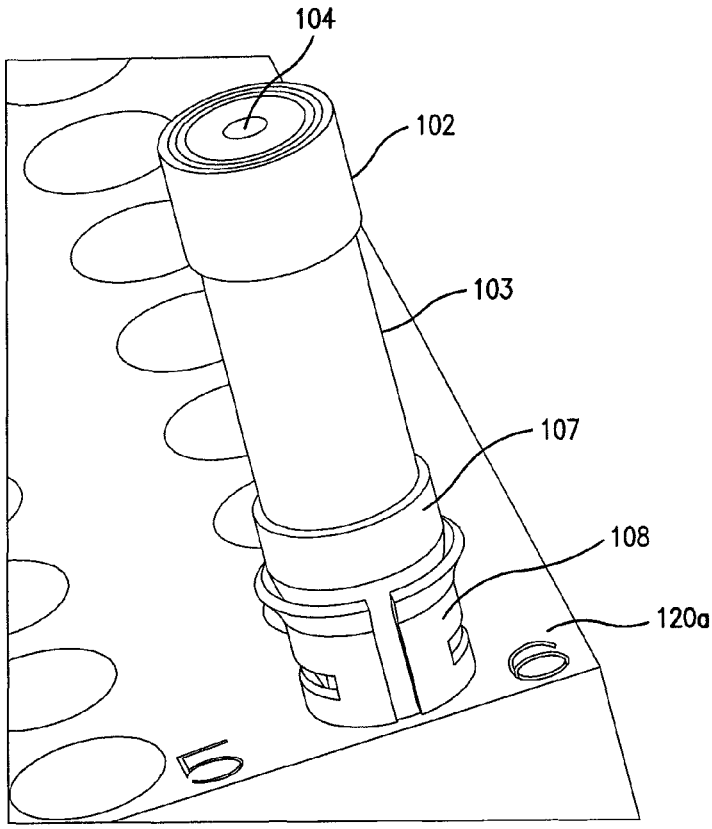
FIG. 3 shows a top perspective view of a portion of a cable array having a cable secured thereto using the connector system of FIG. 1.

For example, referring to FIGS. 1-4, a first embodiment of the connector system of the present invention is shown. Specifically, referring to FIG. 1, the connector system comprises a receptacle 106, which has a first conductive portion 126 and a first engaging member 108. When the receptacle 106 is disposed in a borehole 101 of the substrate 120, as shown in FIG. 2, the conductive portion 126 contacts the conductive substrate 120. If only a portion of the substrate is conductive (e.g., the substrate comprises a metal-plated plastic), then the conductive portion 126 need only contact that portion (e.g., the top surface 120*a*) of the substrate.

In this embodiment, the receptacle is inserted into the borehole 101 as shown in FIG. 2. To secure the receptacle 106 within the bore hole 101 various means can be used, including, for example, an interference fit or an adhesive connection.

The plug 107 is electrically connected to the metallic shielding layer 103 of the cable 102 via the conductive portion 125. The conductive portion 125 may be electrically connected using traditional techniques such as an interference fit (i.e., metal-to-metal), conductive adhesives, crimping, and solder.

The receptacle 106 is configured to receive plug 107. Specifically, the receptacle comprises first engaging member 108 to interengage with the second engagement member 109 of the plug 107. The first and second engagement members may be any know mechanism for connecting a plug to a receptacle, including for example, a hook and latch configuration, snaps, releasable adhesive, a magnetic interface, and a threaded interface. In this embodiment, the first engagement member 108 comprises at least one latch comprising a resilient member 108*a* defined by a plurality of notches 127 about the receptacle 106, and an aperture 108*b* on the resilient member 108. (Alternatively, the latch may comprise a protrusion). The second engagement member 109 comprises a hook, which, in this embodiment, is a protrusion 109*a* configured to be received in the aperture 108*b*. (Alternatively, the hook may comprise an aperture or recess.)

As shown in FIG. 2, because resilient members 108*a* extend beyond the top surface 120*a* of substrate 120, they are free to flex outwardly, as the plug 107 is inserted into receptacle 106. Specifically, as plug 107 is pushed downwardly (relative to FIG. 2) the resilient members 108*a* are deflected outwardly by protrusions 109*a* until protrusions 109*a* align with apertures 108*b*. At this point, the protrusions 109*a* snap into apertures 108*b*, and the resilient member 108*a* return from its deflected position thus capturing the protrusion 109*a* in the aperture 108*b*. Such a mechanism is well known in the art, and other suitable mechanisms will be obvious to one skilled in the art in light of this disclosure.

Figure 4:
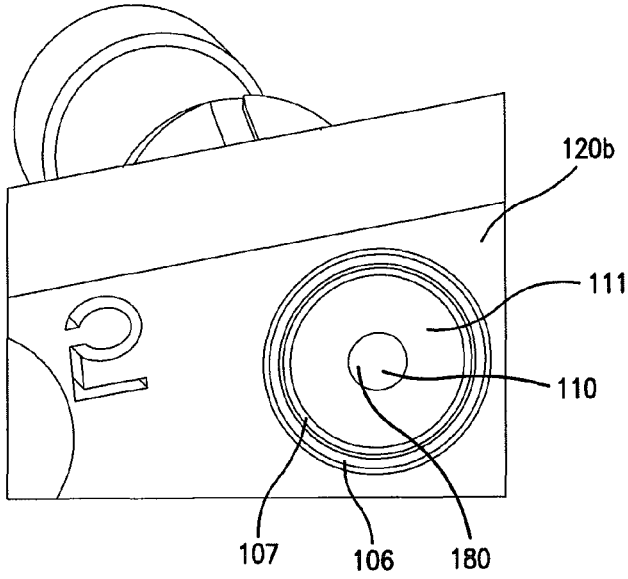
FIG. 4 shows a bottom perspective view of the portion of the array shown in FIG. 3.

In one embodiment, receptacle 106 also comprises a contact 110, which provides an electrical point of contact at the bottom surface 120*b* of the substrate 120. As shown in FIG. 4, the electrical point of contact is a flat surface 180 essentially parallel to the bottom surface 120*b*. To spatially align the contact 110 in the receptacle, a dielectric insert 111 is used. In this embodiment, the dielectric insert is an elongated disk. Once the plug is inserted into the receptacle, the coaxial cable is held securely to the substrate 120, and the contact 110 is presented on the bottom surface 120*b* of the substrate 120 as shown in FIG. 4 for use for testing purposes or other known or later-developed purpose.

Figure 5:
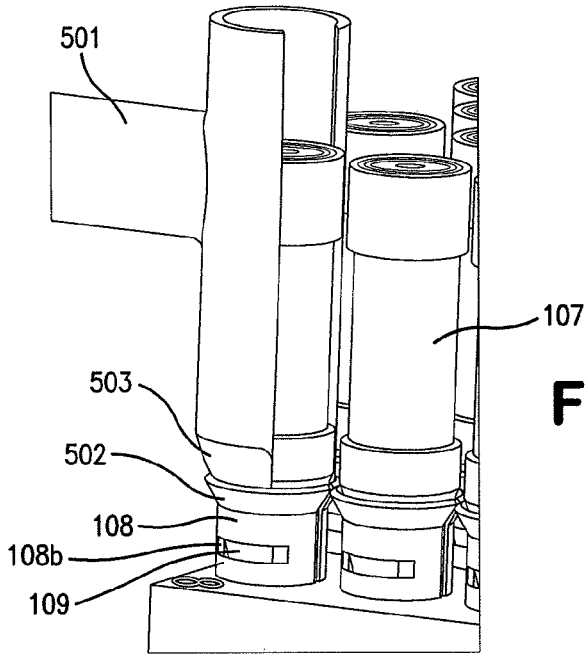
FIG. 5 illustrates the use of a removal tool to remove a cable from a cable array.
Figure 6:
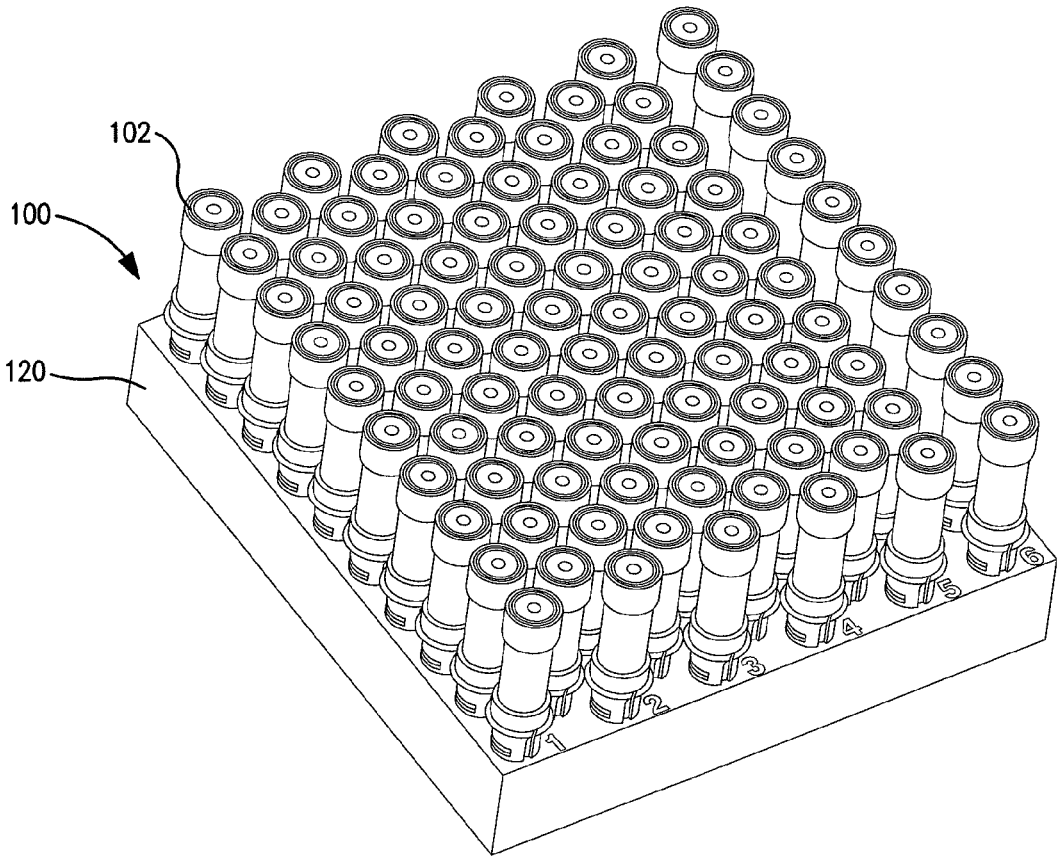
FIG. 6 shows an array of cables secured to the substrate using the connector system of FIG. 1.

The resiliency of the first engaging member 108 allows for the removal of the plug and the coaxial cable form the array 100 using tool 501 as shown in FIG. 5. Specifically, tool 501 comprises a wedge portion 503, which is inserted between the first engaging member 108 and the plug. To facilitate this insertion, the first engagement member 108 may comprise a flange portion 502, which provides a lead-in for the wedge portion 503. Once the tool 501 is positioned so that the wedge portion 503 is disposed between the first engagement member 108 and the plug, it is then pushed downwardly (relative to FIG. 5) to thereby deflect the first engagement member 108 outwardly and away from the plug, thereby freeing the protrusion 109*a* from the aperture 108*b*.

Figure 7:
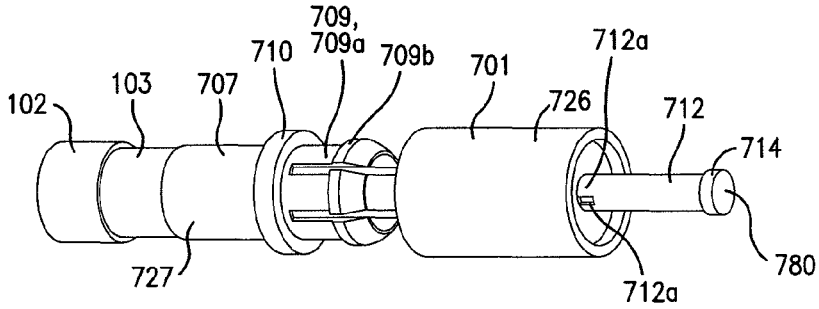
FIG. 7 shows an exploded view of an alternative embodiment of the connector system of the present invention.
Figure 8:
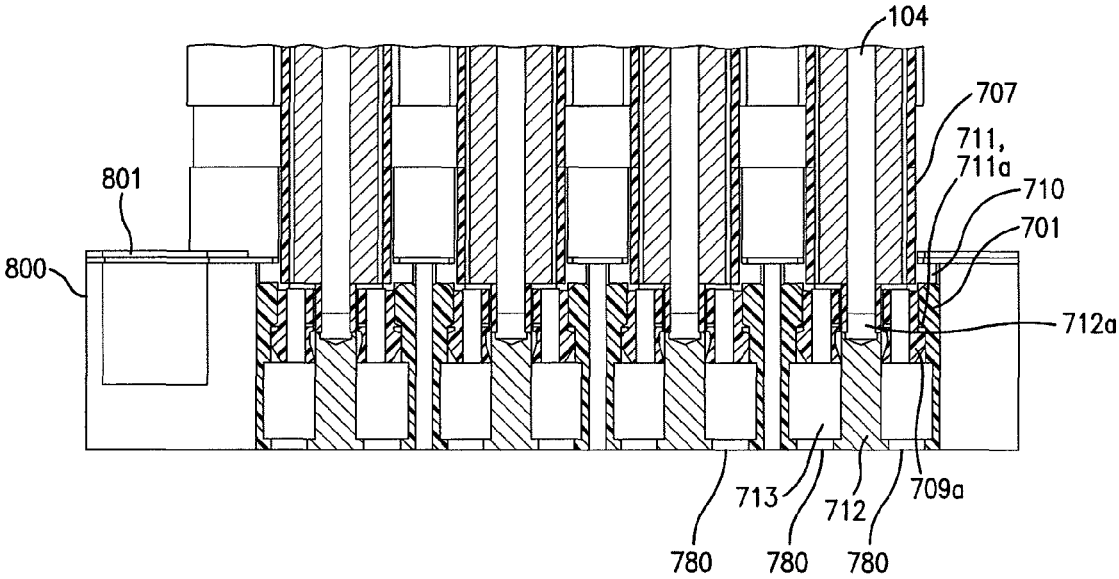
FIG. 8 shows a cross-sectional view of a portion of a cable array using the connector system of FIG. 7.
Figure 9:
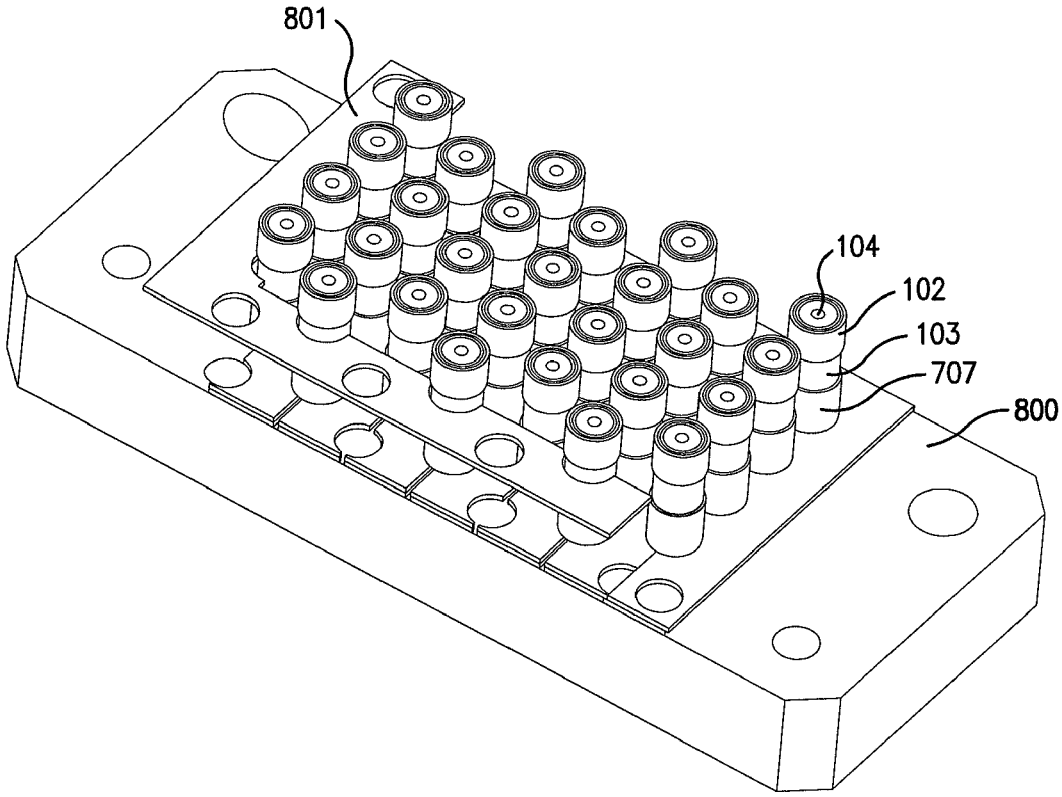
FIG. 9 shows a top perspective view of a cable array using the connector system of FIG. 7 with a portion of a cover plate removed.

Referring to FIGS. 7-9, a second embodiment of the connector system of the present invention is shown. In this embodiment, a receptacle 701 comprises a first conductive portion 726 for electrical connection to the conductive substrate 800, and a first engagement member 711, which, in this embodiment, is an annular ridge 711*a* in the receptacle (see FIG. 8). This particular embodiment also comprises a contact 712 having a head 714 for use in making an electrical connection. As shown in FIGS. 7 and 8, the head 714 comprises a flat surface 780, which is essentially parallel to the bottom surface 720. When the substrate 800 is populated with plugs, the flat surfaces 780 of the contacts 712 essentially lie a plane to facilitate abutment connection with a circuit as described above. The contact 712 is configured to connect to the central conductor 104 by means of two resilient beams 712*a*, which are configured to deflectively receive the center conductor 104. A dielectric spacer 713 is dispose within the receptacle 701 to center the contact 712 as shown in FIG. 8. Rather than the contact 712 being part of the receptacle as shown in FIG. 8, it may be part of the plug. In this respect, the contact 712 may be merely an extended portion of the central conductor 104 (see, for example, FIG. 10).

The connector system of FIG. 7 also comprises a plug 707 having a second conductive portion 125 configured to electrically connect to the metallic shielding layer 103 of the coaxial cable 102. This plug also comprises second engagement means 709, which, in this embodiment, comprises a series of resilient members 709*a* having a latch 709*b*. When the plug 707 is pushed into the receptacle 701, the resilient members 109*a* deform inwardly until latch 709*b* passes the annular ridge 711*a*, at which point, the resilient members 109*a* snap back to their undeflected position such that latch 709*b* grips annular ridge 711*a*.

In this particular embodiment, a cover plate 801 is positioned over substrate 800 after the plug 707 is received in the receptacle 701 as shown in FIG. 9. Specifically, plate 801 is seated above an annular collar 710 to assist the engagement members in holding the plug in the receptacle. It should be understood that, although plate 801 improves the retention of the plug in the receptacle, it is not necessary, and, instead, the retention of the plug may rely only on the first and second engagement members 711, 709.

Figure 10:
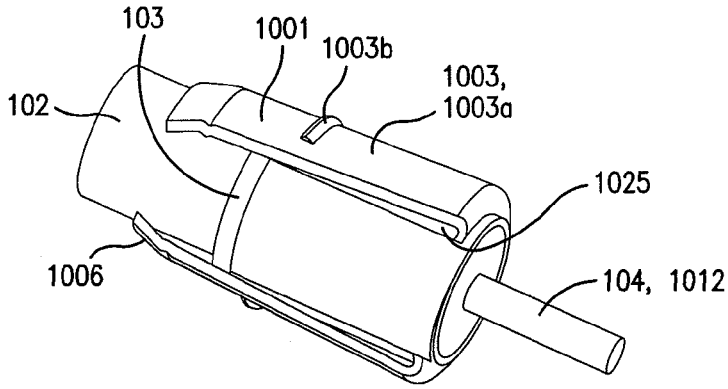
FIG. 10 shows an alternative connector system of the present invention.
Figure 11:
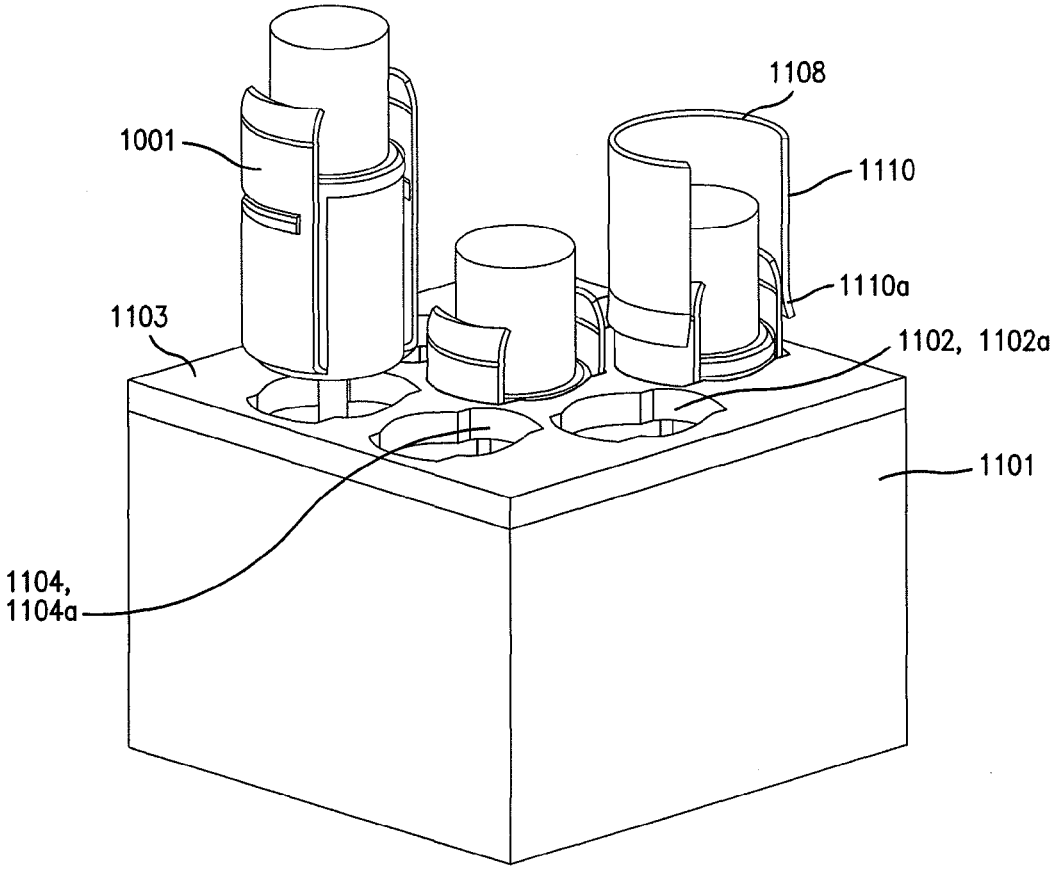
FIG. 11 shows a cable array using the connector system of FIG. 10 and a schematic view of a removal tool to remove a cable from a substrate of the array.
Figure 12:
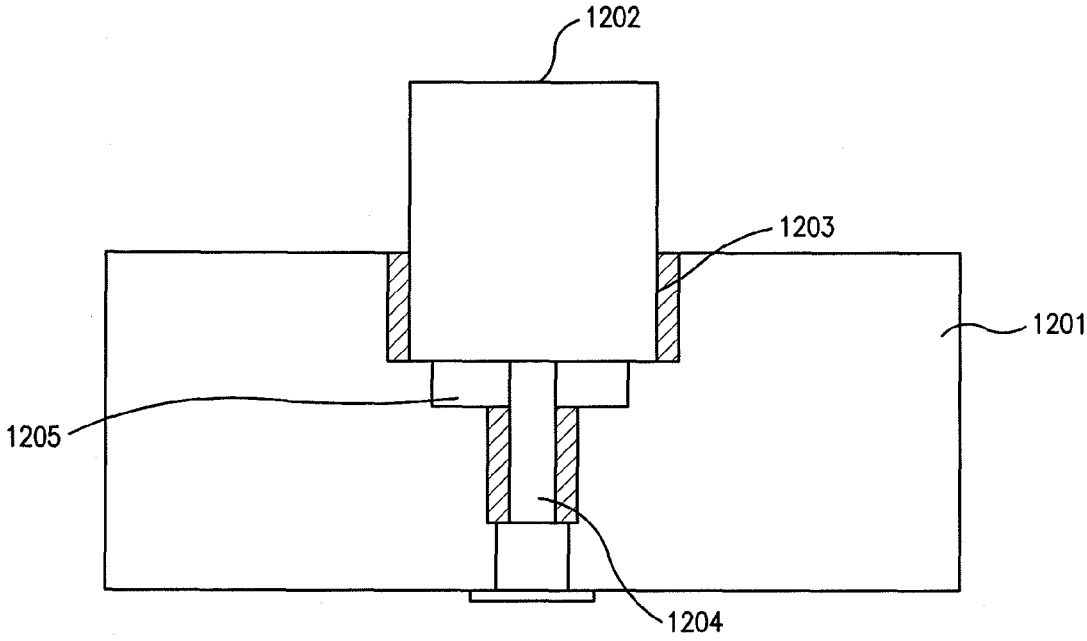
FIG. 12 (PRIOR ART)
FIG. 12 schematically illustrates a prior art soldered connection of a coaxial cable to a printed circuit board.

Referring to FIGS. 10 and 11, yet another embodiment of the connector system is shown. In this embodiment, the receptacle 1102 is not a discreet component disposed within the borehole of the substrate 1101, but rather is an opening 1102*a* in a plate 1103 on the substrate. The first conductive portion in this embodiment is integral with the plate 1103. Likewise, the first engagement member 1104 is the bottom edge 1104*a* along the perimeter of opening 1102*a*. The connector system in this embodiment also comprises a plug 1001 having a second conductive portion 1025, which is soldered to the metallic shielding layer 103 of the coaxial cable 102. The plug 1001 also comprises a second engagement member 1003, which, in this embodiment, comprises at least one resilient member 1003*a* having a protrusion 1003*b*.

In this embodiment, the contact 1012 is the central conductor 104, which is presented at the bottom surface of substrate 1101 when the plug 1001 is secured to the substrate 1101. Although a portion of the central conductor 104 extends beyond the other components of the coaxial cable in this embodiment, the central conductor 104 may also be flush with the remainder of the cable.

As shown in FIG. 11, as the cable terminated with plug 1001 is inserted into the receptacle 1102, resilient member 1003*a* is urged inwardly until protrusion 1003*b* is below the bottom edge 1104*a*, at which point, the resilient member 1003*a* snaps back to its undeflected position such that protrusion 1003*b* is caught under bottom edge 1104*a*, thereby retaining the plug 1001 in the substrate 1101.

As shown in FIG. 11, the plug may be removed or released from the substrate 1101 by moving the resilient member 1003*a* inwardly to free the protrusion 1003*b* from the cover plate 1103. To this end, a tool 1108, which is configured to snugly fit about the plug 1001, is disposed about the plug and pushed down to thereby urge the resilient members 1003*a* inwardly to release the protrusion 1003*b* as discussed above. To facilitate the placement of the cylindrical portion 1110 of tool 1108 around the plug 1001, a lead-in flange 1006 on the resilient member 1003*a* may be used. Alternatively or in conjunction with the lead-in flange 1006, the tool 1108 may comprise an inwardly tapered cylindrical portion 1110*a* to receive the plug 1001, and urge the resilient member 1003*a* inwardly as the tool slides over it.

While this description is made with reference to exemplary embodiments, it will be understood by those skilled in the art that various changes may be made and equivalents may be substituted for elements thereof without departing from the scope. In addition, many modifications may be made to adapt a particular situation or material to the teachings hereof without departing from the essential scope. Also, in the drawings and the description, there have been disclosed exemplary embodiments and, although specific terms may have been employed, they are unless otherwise stated used in a generic and descriptive sense only and not for purposes of limitation, the scope of the claims therefore not being so limited. Moreover, one skilled in the art will appreciate that certain steps of the methods discussed herein may be sequenced in alternative order or steps may be combined. Therefore, it is intended that the appended claims not be limited to the particular embodiment disclosed herein.

What is claimed is:

1. An array of coaxial cables comprising:

a planar, conductive substrate having a top surface, a bottom surface, and a plurality of boreholes from said top surface to said bottom surface;

a plurality of coaxial cables, each cable comprising a central conductor, a dielectric insulating layer surrounding said central conductor, and a metallic shielding layer surrounding said dielectric insulating layer;

a plurality of receptacles, each receptacle being disposed proximate one of said plurality of boreholes, each receptacle having a first conductive member electrically coupled to said conductive substrate and a first engagement member;

a plurality of plugs, each plug being disposed on one of said plurality of coaxial cables, each plug having a second conductive member electrically coupled to said metallic shielding layer and a second engagement member, said first and second engagement members of a respective plug and receptacle interengaging to releasably connect and electrically couple said plug and receptacle; and a plurality of contacts, each contact electrically coupled to said central conductor and presenting a flat surface at said bottom surface such that the flat surfaces of said contacts lie essentially in a plane parallel to said bottom surface thereby facilitating an abutment connection with circuitry for testing.

2. The array of claim 1, wherein said each receptacle is disposed at least partially in one of said plurality of boreholes.

3. The array of claim 1, wherein said first engagement member is integral with said first conductive member, and wherein said second engagement member is integral with said second conductive member.

4. The array of claim 1, wherein said first engagement member is a ridge within said receptacle and said second engagement member is a resilient member with a latch for interengaging with said ridge.

5. The array of claim 1, wherein said receptacle further comprises a dielectric insulator disposed about said contact and configured for spatially orienting and electrically isolating said contact from said substrate.

6. The array of claim 1, wherein said contact is discrete from said central conductor and comprises resilient members for coupling with said central conductor.

7. The array of claim 6, wherein said contact is permanently connected to said receptacle.

8. The array of claim 1, wherein said first engagement member is a resilient member extending above said top surface.

9. The array of claim 8, wherein said first engagement member comprises an aperture defined by said resilient member and said second engagement member is a protrusion on said plug housing.

10. The array of claim 1, wherein said contact is permanently connected to said plug.

11. The array of claim 10, wherein said contact is said central conductor.

12. The array of claim 11, wherein said contact is a portion of said central conductor that extends beyond said metallic shielding layer.

13. A connector system for coupling coaxial cable to a substrate, said coaxial cable comprising a central conductor, a dielectric insulating layer surrounding said central conductor, and a metallic shielding layer surrounding said dielectric insulating layer, said connector system comprising:

a receptacle configured to be disposed in a borehole of a conductive substrate, said receptacle having a first conductive member configured for electrical coupling to said conductive substrate and a first engagement member;

a plug having a second conductive member configured for electrical coupling to said metallic shielding layer, and a second engagement member, said first and second engagement members configured to interengage to releasably connect and electrically couple said plug and receptacle;

a contact adapted to be electrically coupled to said central conductor; and a tool for disengaging said first and second members, said tool comprising at least a wedge portion configured to slide between said receptacle and said plug to urge said second engagement member away from said first engagement member, thereby releasing said plug from said receptacle.

14. The connector system of claim 13, wherein said tool comprises a cylindrical portion configured to slide around said plug to urge said second engagement member inwardly to disengage it from said first engagement member, thereby releasing said plug from said receptacle.

15. The connector system of claim 13, wherein said contact is discrete from said central conductor and comprises resilient members for coupling with said central conductor.

16. The connector system of claim 13, wherein said contact is connected permanently to said receptacle.

17. The connector system of claim 13, wherein one of either said first or second engagement member is a resilient member having a latch and the other engagement member is a hook.

18. The connector system of claim 17, wherein said first engagement member is integral with said first conductive member and said second engagement member is integral with said second conductive member.

* * * * *